US005325811A

United States Patent [19]

Miroyan

[11] Patent Number: 5,325,811

[45] Date of Patent: Jul. 5, 1994

[54] BOOKMARK

[76] Inventor: Michael Miroyan, P.O. Box 3007, San Pedro, Calif. 90731

[21] Appl. No.: 77,554

[22] Filed: Jun. 14, 1993

[51] Int. Cl.[5] ..... B42D 9/00

[52] U.S. Cl. ..... 116/235; 116/322; 116/240; D19/34

[58] Field of Search ..... 116/234, 235, 240, 322; 281/42; D19/34

[56] References Cited

U.S. PATENT DOCUMENTS

| | | | |
|---|---|---|---|
| 1,334,525 | 3/1920 | Denhard | 116/235 |
| 2,953,115 | 9/1960 | Haskins | 116/235 |
| 4,799,812 | 1/1989 | Warwick | 116/240 X |
| 4,901,665 | 2/1990 | Carlin | 116/235 |
| 4,934,304 | 6/1990 | Rosen | 116/234 X |
| 5,081,948 | 1/1992 | Walsh | 116/240 X |

*Primary Examiner*—Daniel M. Yasich
*Attorney, Agent, or Firm*—J. E. Brunton

[57] ABSTRACT

A bookmark for making a page and line in a book. The bookmark includes an elongated planar body having an upper terminal portion that provides a relatively large flat surface for the display of matter such as decorative and whimsical designs each of which includes a dominant design element. The bookmark further includes a finger engaging indicator piece that substantially corresponds in size and shape with the dominant design element of the imprinted design and is slidably movable along a slit provided in the body from a first position overlying the design element to a second line marking position.

8 Claims, 2 Drawing Sheets

BOOKMARK

BACKGROUND OF THE INVENTION

1. Field of the Invention

The present invention relates generally to bookmarks. More particularly, the invention concerns speciality bookmarks of novel appearance which return the reader to the exact page and line where the reader finished reading.

2. Discussion of the Invention

A great number of bookmark constructions have been suggested in the past. Many of these constructions embody some type of line indicator element which is movable along the length of the bookmark for use in indicating a particular line of print located on a selected page of the book. Some of the line indicator elements are of relatively complex construction and involve rotatable arrows and the like. Exemplary of this type of construction is that disclosed in U.S. Pat. No. 5,081,948 issued to Walsh.

Another prior art construction disclosed in U.S. Pat. No. 4,901,665 issued to Carlin includes a slidable indicator element that is provided with index means viewable from both sides of the body for alignment with the line of interest.

A slight variation in the theme is disclosed in U.S. Pat. No. 2,630,777 issued to Johnson. The bookmark of this patent comprises a body portion provided with parallel slits which define tracks along which a line indicator element travels. The indicator element comprises oppositely extending pointers that override the tracks. A somewhat similar type of bookmark construction is disclosed in U.S. Pat. No. 1,008,481 issued to Lopes.

The bookmark of the present invention is of a substantially simpler construction than those of the prior art and also provides whimsical and decorative design indicia of which the line indicator uniquely forms a part. More particularly, the line indicator element of the bookmark corresponds in size, shape and color to one of the features of the design indicia that is imprinted upon the upper terminal portion of the bookmark. Initially, the line indicator element overlies the printed design feature to which it corresponds, but can readily be moved downwardly along a track-defining slit to a second line indicating position when the bookmark is in use. A different, or corresponding design indicia can also be imprinted on the lower terminal portion with which the indicator element can interact. The simplicity and decorative nature of the bookmark of the invention makes it highly commercially attractive and yet simple and inexpensive to manufacture.

SUMMARY OF THE INVENTION

It is an object of the present invention to provide a simple, inexpensive and efficient article for marking any page in a book and for marking a particular line of print on that page.

Another object of the invention is to provide an article of the aforementioned character which includes an elongated planar body having an upper terminal portion that provides a relatively large flat surface for the display of matter such as decorative and whimsical designs each of which includes a dominant design element.

Another object of the invention is to provide an article as described in the preceding paragraphs which includes a finger engaging indicator piece that substantially corresponds in size and shape with the dominant design element of the imprinted design and is slidably movable along the length of the elongated body from a first position overlying the design element to a second line marking position. Ultimately the indicator piece can be moved into alignment with the dominant design element of a design imprinted on the lower portion of the bookmark.

DESCRIPTION OF THE INVENTION

Figure 1:
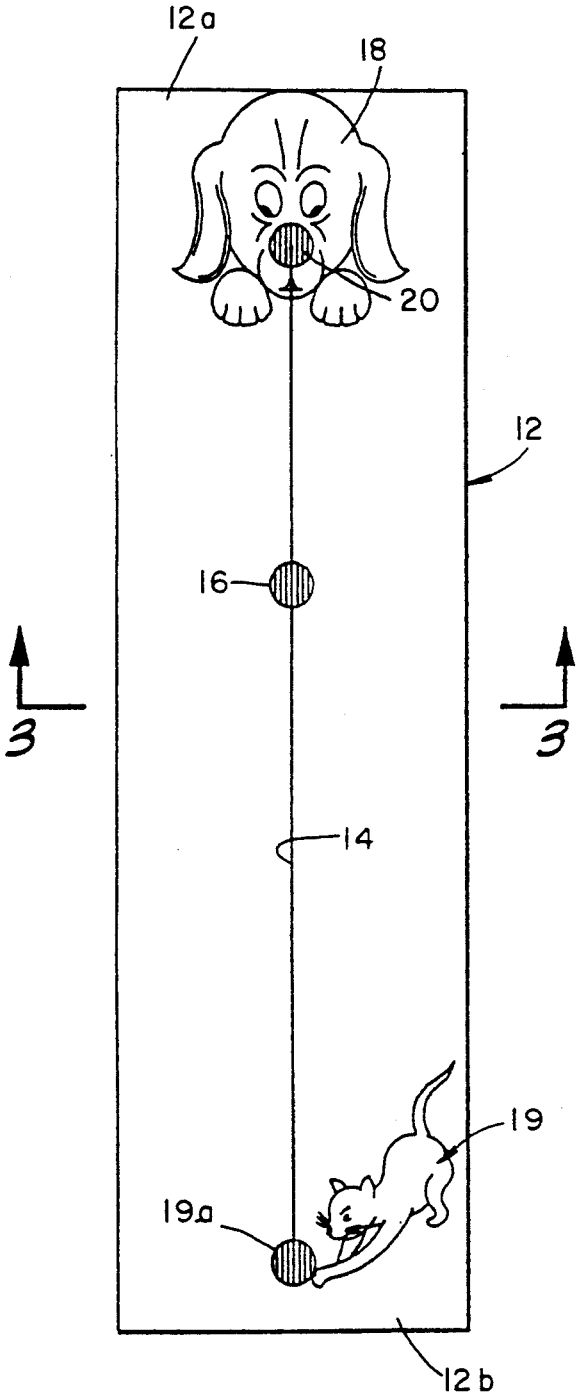
FIG. 1 is a front plan view of one form of the bookmark device of the present invention.
Figure 2:
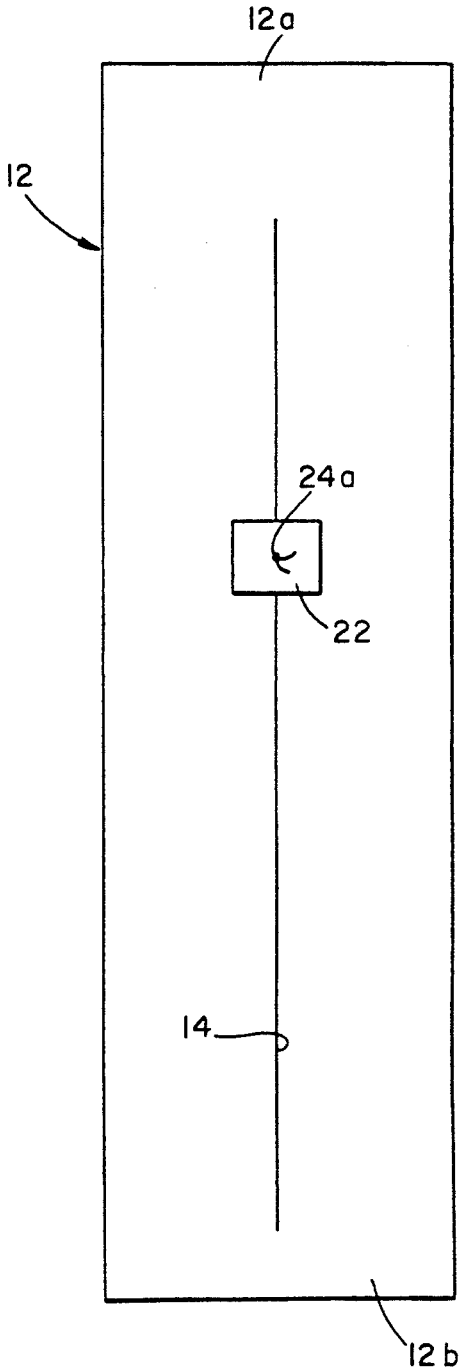
FIG. 2 is a rear plan view of the device.
Figure 3:
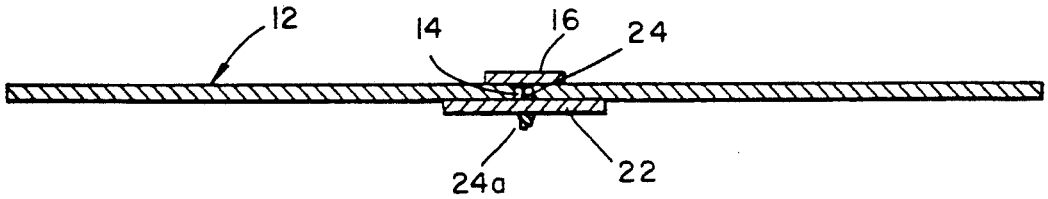
FIG. 3 is an enlarged cross-sectional view taken along lines 3—3 of FIG. 1.

Referring to the drawings and particularly to FIGS. 1, 2, and 3, the bookmark device of the present invention comprises an elongated body 12 having an upper terminal portion 12*a* and a lower terminal portion 12*b*. A longitudinally extending slit 14 extends between the upper and lower terminal portions and defines a track along which the indicator element 16 of the device can be moved in a manner presently to be described. Body 12 can be constructed from plastic, paper, cardboard, or any other suitably durable material.

As best seen in FIG. 1, a display or indicia 18, shown here in the form of a whimsical dog, is imprinted on the upper portion 12*a* of body 12. The display indicia 18 includes a prominent object-depicting feature shown here as the dog's nose 20 which is generally circular in shape. As shown in FIG. 1, slit 14 terminates at its upper end at the approximate center of the object-depicting feature or element 20. A second whimsical indicia here shown as a kitten 19, is imprinted on the lower terminal portion and the design feature or element such as a ball 19*a* interacts with the indicator element 16 when element 16 is moved to the lower extremity of the slit.

In the present form of the invention, indicator element 16 which comprises a portion of the indicator means of the invention, corresponds in size, shape and color to the dog's nose or feature 20 and also to feature 19*a* of the lower design. The indicator element functions to indicate a particular line on the selected page of a book such as the book shown in FIG. 4 and generally identified by the numeral 21. Further comprising the indicator means of the present embodiment of the invention is a backing member 22 which, as shown in FIG. 3, is interconnected with indicator element 16 by means of connector means shown here as a short length of connector cord 24. One end of cord 24 is affixed by any suitable means to the underside of indicator element 16 while the other end thereof extends through backing member 22 and terminates in an enlarged diameter, knot-like portion 24*a* which engages the rear surface of backing member 22. Cord 24 is of a length such that indicator element 16 is at all times maintained in close proximity with the front face of body 12 as the indicator element slides along its guide track which is defined by slit 14. It is to be understood that the connector means can take various forms such as snap connector, a plastic filament that is heat molded to the indicator element and the backing member, or any other suitable means for interconnecting the two members.

A highly unique feature of the device of the present invention resides in the fact that, when the bookmark is not in use, indicator element 16 overlies object-depicting feature 19*a* or 20 and appears to be a part of the imprinted display. In use, however, indicator element 16 can be moved away from the display, either upwardly or downwardly in the manner illustrated in FIG. 1, and into alignment with a specific line of print identified in FIG. 1 by the numeral 26.

It is to be understood that different or corresponding designs can be imprinted on both the upper and lower portions of the face of the bookmark and the indicator element can be moved from an overlying position on the upper design to an overlying position on the lower portion.

Figure 4:
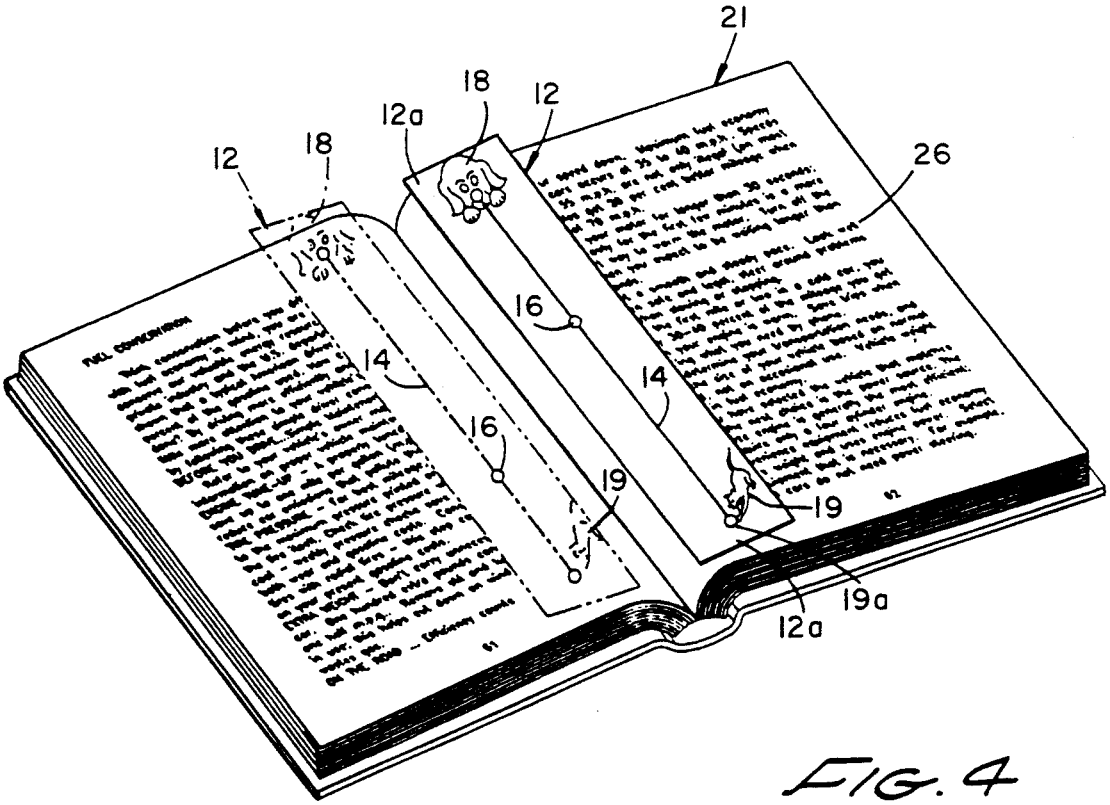
FIG. 4 is a generally illustrative view of the use of the bookmark for marking a particular page in a book and for indicating a particular line of print on that page.

Referring particularly to FIG. 4, in using the bookmark of the present invention to identify a specific page and line, the bookmark is placed on either the right-hand or left-hand page depending upon which page was last read by the user. With the display facing upwardly, the bookmark is moved either upwardly or downwardly to a position where the line to be indicated falls within the length of slit 14. Next, the bookmark is pressed against the selected page with one hand while the finger of the other hand is used to slide indicator element 16 along the track or slit until it aligns with a selected line, such as line 26.

It is to be understood that when the book is opened, the bookmark may fall against the right-hand page as shown by the solid lines in FIG. 4, or against the left-hand page as shown by the phantom lines. However, when the display indicia 18, which is imprinted on the bookmark, can be viewed, that is face up, the user will at once know that the page against which the back surface of the bookmark rests is the last page which was being read. Then by looking at the line that is proximate the indicator element, the user will at once know the last line which was read.

It is to be understood that the display which is imprinted on the upper and lower terminal portions of the bookmark can be of any object such as an animal, a balloon, or group of balloons, a piece of fruit hanging of a tree, a bowl of fruit, an ornament, a pyramid, a flower, an egg, or any other display that includes at least one object-depicting feature having a particular size and shape and being located proximate the upper extremity of slit 14. When the bookmark is not in use, the object-depicting feature is covered by the line indicating element which is of the same size, shape, color and configuration as the object-depicting feature. When the bookmark is in use, the element which overlies the object-depicting feature can then be moved downwardly along slit 14 to function as the line indicator element. When the bookmark is not in use, element 16 can, once again, be moved upwardly of the track and be repositioned over the object-depicting feature of the display to which it corresponds. When in the position, the indicator element appears to be an integral part of the printed display itself. This novel feature, which is neither shown nor suggested by the prior art provides a highly commercially attractive aspect of the device of the invention and renders it both attractive and unique in appearance and operation.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A bookmark for locating an exact page and line in a book comprising:

(a) a thin, elongated, planar body having a face and a back, said face having an upper terminal portion and a lower terminal portion, said body having a slit extending between said upper and lower terminal portions, said slit defining a track;

(b) a first display imprinted on said upper terminal portion of said face of said body, said first display including at least one object depicting feature having a particular size and shape and being located proximate said slit;

(c) a second display imprinted on said lower terminal portion of said face of said body, said second display including an object-depicting feature generally corresponding to said object-depicting feature imprinted on said upper terminal portion; and (d) an indicator means for indicating a particular line on a selected page of the book, said indicator means comprising:

(i) an indicator element overlying said face of said body proximate said slit and having a size and shape corresponding to the size and shape of said object-depicting feature of said display, said element being movable along said track from a first position overlying said object-depicting feature of said first display, to a second position on said face intermediate said upper and lower terminal portions of said body, to a third position overlying said object-depicting feature of said second display;

(ii) a backing member overlying said back of said body proximate said slit; and (iii) flexible connector means for interconnecting said backing member and said indicator element through said slit.

2. A bookmark as defined in claim 1 in which the said connector means comprise a short length of cord connected at one end to said indicator element and at its other end to said backing member.

3. A bookmark as defined in claim 2 in which said display comprises a depiction of a dog and in which said object-depicting feature thereof comprises a depiction of the nose of said dog, said depiction being substantially circular in shape.

4. A bookmark as defined in claim 2 in which said display comprises a depiction of an animal and in which said object-depicting feature thereof comprises a depiction of the nose of said animal, said depiction being substantially circular in shape.

5. A bookmark as defined in claim 2 in which said backing member comprises a thin sheet of planar material having an aperture for receiving said cord.

6. A bookmark for locating an exact page and line in a book comprising:

(a) a thin, elongated, planar body having, a face and a back, said face having an upper terminal portion and a lower terminal portion, said body having a slit extending between said upper and lower terminal portions, said slit defining a track;

(b) of said face of said body, said display including at least one object depicting feature having a particular size and shape and being located proximate said slit; and (c) an indicator means for indicating a particular line on a selected page of the book, said indicator means comprising:

(i) an indicator element overlying said face of said body proximate said slit and having a size and shape corresponding to the size and shape of said object-depicting feature of said display, said element being movable along said track from a first position overlying said object-depicting feature to a second position on said face intermediate said upper and lower terminal portions of said body;

(ii) a backing member overlying said back of said body proximate said slit; and (iii) connector means for interconnecting said backing member and said indicator element, said connector means comprising a short length of cord connected at one end to said indicator element and at its other end to said backing member through said aperture.

7. A bookmark for locating an exact page and line in a book comprising:

(a) a thin, elongated, planar body having a face and a back, said face having an upper terminal portion and a lower terminal portion, said body having a slit extending between said upper and lower terminal portions, said slit defining a track;

(b) a first display imprinted on said upper terminal portion of said face of said body, said first display including at least one object depicting feature having a particular size and shape and being located proximate said slit;

(c) a second display imprinted on said lower terminal portion of said face of said body, said second display including an object-depicting feature generally corresponding to said object-depicting feature imprinted on said upper terminal portion; and (d) an indicator means for indicating a particular line on a selected page of the book said indicator means comprising:

(i) an indicator element overlying said face of said body proximate said slit and having a size and shape corresponding to the size and shape of said object-depicting feature of said display, said element being movable along said track from a first position proximate said object-depicting feature of said first display, to a second position on said face intermediate said upper and lower terminal portions of said body, to a third position proximate said object-depicting feature of said second display; and (ii) means for slidably interconnecting said indicator element with said body to permit said indicator element to slide along said slit between said first and second positions.

8. A bookmark as defined in claim 7 in which said means for slidably interconnecting said indicator element with said body comprising a backing member overlying said back of said body proximate said slit and connector means for interconnecting said backing member with said indicator element, said connector means comprising a connector cord.

* * * * *